US008121513B2

(12) United States Patent
Izawa et al.

(10) Patent No.: US 8,121,513 B2
(45) Date of Patent: Feb. 21, 2012

(54) ELECTROPHOTOGRAPHIC PRINTER HAVING A TRANSFER ROLLER

(75) Inventors: Hideo Izawa, Narashino (JP); Junichi Setoyama, Narashino (JP); Nobuyuki Kikuchi, Yokote (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 488 days.

(21) Appl. No.: 12/331,247

(22) Filed: Dec. 9, 2008

(65) Prior Publication Data

US 2009/0169238 A1 Jul. 2, 2009

(30) Foreign Application Priority Data

Dec. 27, 2007 (JP) ..... 2007-336445

(51) Int. Cl.
*G03G 15/16* (2006.01)

(52) U.S. Cl. ..... 399/101

(58) Field of Classification Search ..... 399/101, 399/348

See application file for complete search history.

(56) References Cited

U.S. PATENT DOCUMENTS

| | | | | |
|---|---|---|---|---|
| 6,978,111 | B2 * | 12/2005 | Nagata et al. | 399/348 |
| 2007/0177914 | A1 * | 8/2007 | Maseki et al. | 399/348 |
| 2007/0223980 | A1 * | 9/2007 | Fukumoto et al. | 399/348 |

FOREIGN PATENT DOCUMENTS

| | | |
|---|---|---|
| JP | 2005-99127 | 4/2005 |
| JP | 2007-011142 | 1/2007 |
| JP | 2007-93982 | 4/2007 |

* cited by examiner

*Primary Examiner* — David Gray
*Assistant Examiner* — Gregory H Curran
(74) *Attorney, Agent, or Firm* — Cozen O'Connor

(57) ABSTRACT

A cleanable electrophotographic printer that meets the requirement for high speed printing on a continuous web of paper as the printing medium and which minimizes the amount of toner that remains on the surface of a rotating transfer roller even in high-speed production, wherein the electrophotographic printer is provided with a carrier solution supply device disposed in an area upstream of a transfer roller cleaning device in the rotation direction of the rotating transfer roller for supplying the surface of the rotating transfer roller with a carrier solution.

3 Claims, 2 Drawing Sheets

ELECTROPHOTOGRAPHIC PRINTER HAVING A TRANSFER ROLLER

TECHNICAL FIELD

The present invention relates to an electrophotographic printer in which a toner image formed on a photoconductor drum is transferred via a transfer roller onto a recording medium and in which the surface of the rotating transfer roller after the transfer is cleaned by a transfer roller cleaning device.

BACKGROUND ART

In an electrophotographic printer in which a toner image formed on the rotating photoconductor drum is transferred by the primary transfer onto the surface of the rotating transfer roller and the toner image transferred to the rotating transfer roller is then transferred by the secondary transfer onto a moving recording medium for image formation, the surface of the rotating transfer roller immediately after the toner image has been transferred onto the moving recording medium has a residual amount of toner adhered in the state that it has almost dried because a carrier solution is absorbed on the recording medium.

In removing a residual toner on the surface of a rotating transfer roller, it is generally effective to scrape off a major portion of residual toner with a cleaning blade and then to wipe off minute adhered residual toner which have not been removed by the cleaning blade.

However, the residual toner if they remain almost dried cannot be well scraped off by the cleaning blade and there is also a problem in durability of the cleaning blade.

Accordingly, of transfer roller cleaning devices of this type, there has been known one in which downstream of a transfer area on the transfer roller of an image onto the recording medium in the rotation direction of the rotating transfer roller, there are disposed in order from upstream in the rotation direction of the transfer roller a wiping roll rotating reversely in rubbing contact with the surface of the rotating transfer roller and a blade scraper whereby the wiping roll is supplied with a cleaning solution from a supply nozzle while the wiping roll is rotated so that residual toner remaining on the surface of the transfer roller can be wiped off with the cleaning solution, followed by removal of still adhered residual toner with the blade scraper, thereby cleaning the surface of the transfer roller (see JP 2007-11142 A).

In the known transfer roller cleaning device mentioned above in which the wiping roll supplied with the cleaning solution is rotated in rubbing contact with the surface of the transfer roller, the cleaning solution is applied to the residual toner on the surface of the transfer roller where the wiping roll is in rubbing contact with the transfer roller. Consequently, when the transfer roller is rotated at a high speed, it may not be done in time to clean residual toner with the cleaning solution; hence it is hard to meet the requirement for high speed printing with a continuous web of paper.

DISCLOSURE OF THE INVENTION

With the such problems taken in account, it is an object of the present invention to provide a transfer roller cleaning device in an electrophotographic printer with the ability to meet the requirement for high speed printing on a continuous web of paper as the printing medium and to make minimum the amount of toner that remains on the surface of a rotating transfer roller even in high-speed production of a printed matter.

In order to achieve the object mentioned above, there is provided in accordance with the present invention an electrophotographic printer in which a toner image formed on a rotating photoconductor drum is transferred via a rotating transfer roller onto a recording medium and in which a surface of the rotating transfer roller after the transfer is cleaned by a transfer roller cleaning device, characterized in that it comprises a carrier solution supply device disposed in an area upstream of the transfer roller cleaning device in the rotation direction of the rotating transfer roller for supplying the surface of the rotating transfer roller with a carrier solution.

The transfer roller cleaning device may include: disposed in the rotation direction of the rotating transfer roller, a blade scraper in contact with the surface of the rotating transfer roller and a wiping roll rotating reversely in rubbing contact with the surface of the rotating transfer roller; a brush roll disposed to rotate reversely in contact with the surface of the rotating wiping roll, a portion of the bush roll being immersed in the carrier solution; and a squeezing roll disposed to rotate normally in pressure contact with the surface of the rotating wiping roll.

According to the present invention, the ability to supply the surface of a transfer roller with a carrier solution upstream of an area where cleaning is effected by the transfer roller cleaning device allows residual toner adhered as dried to the transfer roller surface prior to the cleaning effected by the transfer roller cleaning device to become softened with the carrier solution, thereby to allow cleaning to be effected with the transfer roller cleaning device so as to minimize the amount of toner that remains on the surface of a rotating transfer roller even in high-speed printing on a continuous web of paper as the recording medium In the transfer roller cleaning device mentioned above, the wiping roll in rubbing contact with the transfer roller is supplied with the carrier solution and is cleaned of its surface by means of a brush roll whereby if it is formed of a sponge, its cleaning effect becomes so thorough as to extend to its surface pore insides, thereby improving its ability to clean while making it available over a prolonged time period. The result is an efficient production in the maintenance and operation.

BEST MODES FOR CARRYING OUT THE INVENTION

Figure 1:
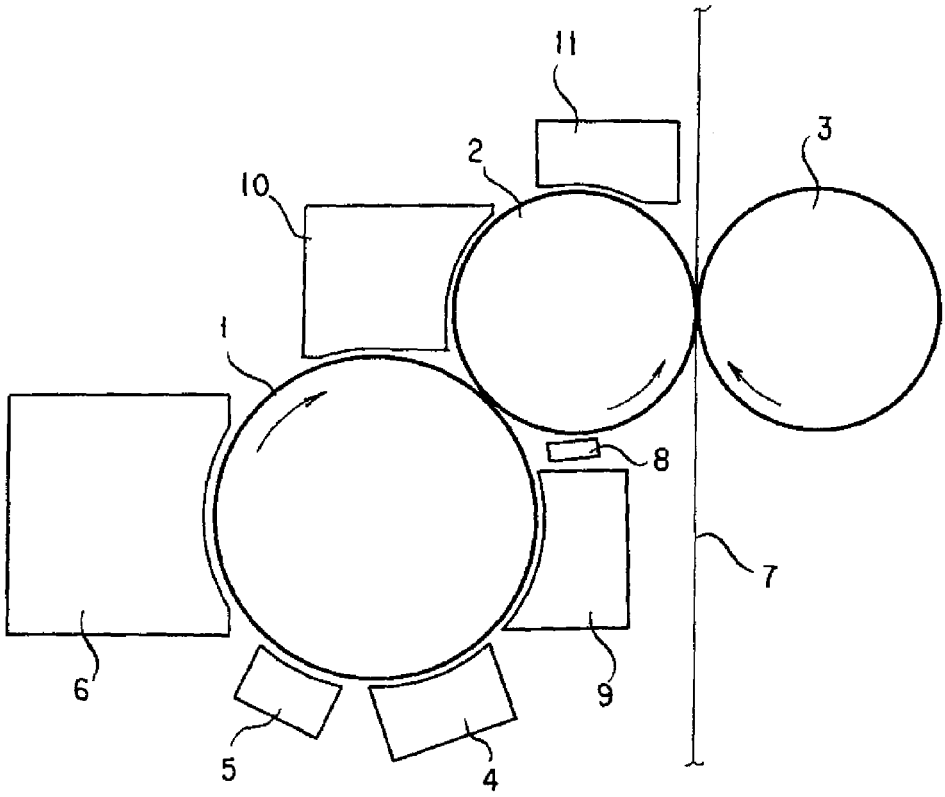
FIG. 1 is an explanatory view illustrating the makeup of an electrophotographic printer in which the present invention is curried out.

FIG. 1 is an explanatory view illustrating the makeup of an electrophotographic printer in which the present invention is curried out. As shown, a photoconductor drum 1 is opposed to and in contact with a transfer roller 2 which in turn is opposed to and in contact with a backup roll 3.

In the electrophotographic printer, the photoconductor drum 1 is rotated by a drive means such as a motor (not shown) at a constant speed in a direction of the arrow. The surface of the photoconductor drum 1 is charged uniformly with electricity in the dark by a charging unit 4 and then has an electrostatic latent image formed thereon of an original light figure when irradiated by an exposure unit 5 for image formation. Thereafter, the electrostatic latent image when passing through its processing region is visualized by a developing unit 6, forming a toner image on the surface of the photoconductor drum 1.

The toner image on the surface of the photoconductor drum 1 is primarily transferred on the surface of the transfer roller 2 in its transfer region by a bias pressure applied through the transfer roller 2 and a nip voltage between the drums. This primarily transferred toner image is secondarily transferred in its second transfer region on a recording medium 7 passing through between the transfer roller 2 and the backup roll 3.

The recording medium 7 on which the toner image is secondarily transferred has the toner image fixed thereon by a fixing unit (dryer) not shown and then is discharged out of the printer. On the other hand, after the primary transfer, a residual potential that remains on the photoconductor drum 1 is removed by a static eliminator 8. And, the carrier solution and a residual toner that remain on the photoconductor drum 1 after the primary transfer is completed are removed by a photoconductor drum cleaning device 9 in an area downstream of the static eliminator 8.

In the Figure, reference numeral 10 indicates a transfer roller cleaning device disposed opposite to a surface of the transfer roller 2 upstream of a transfer area in which it is opposite to and in contact with the photoconductor drum 1. And, reference numeral 11 indicates a carrier solution supply device disposed opposite to a surface of the transfer roller 2 upstream of the transfer roller cleaning device 10. And, the transfer roller cleaning device 10 and the carrier solution supply device 11 are constructed as shown in FIG. 2.

Figure 2:
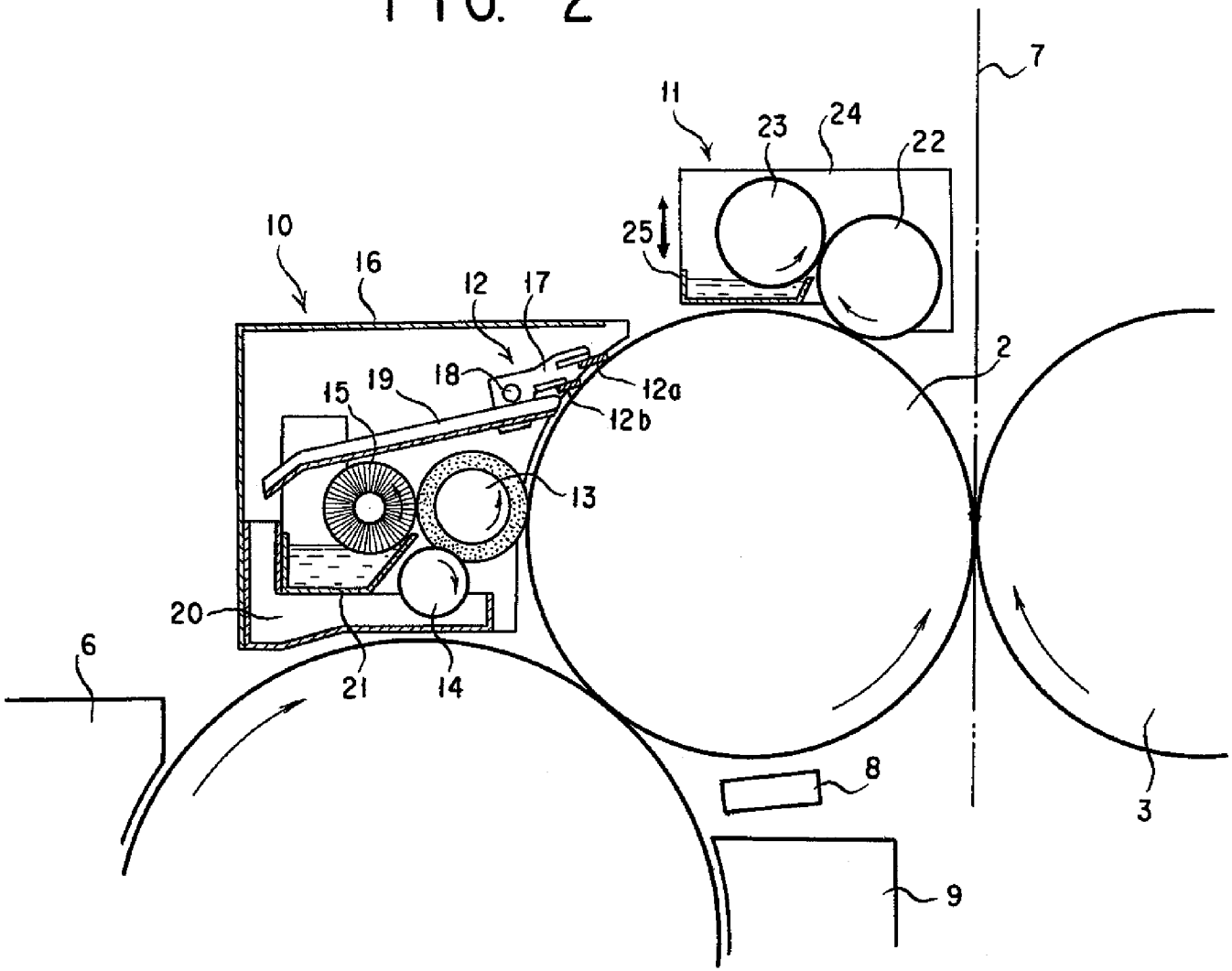
FIG. 2 is a cross sectional view illustrating the essential part of a form of implementation of the present invention.

The transfer roller cleaning device 10 shown in FIG. 2 comprises a blade scraper 12, a wiping roll 13, a squeezing roll, a brush roll 15 and a case 16 to house them.

The blade scraper 12 comprises a pair of blades 12*a* and 12*b* whose ends are in frictional sliding (rubbing) contact with the transfer roller 2 and a bracket 17 to which the two blades 12*a* and 12*b* are fastened in the state that they are spaced apart in a direction in which the transfer roller 2 is rotated. And, the bracket 17 is securely connected to a side of the case 16 via a fastening element (mounting screw) 18 such that loosening the fastening element 18 allows the bracket 17 to be rotated for adjusting the strength of pressure contact of the blades 12*a* and 12*b* against the peripheral surface of the transfer roller 2. Each of the ends of the blades 12*a* and 12*b* is positioned above a center of rotation of the bracket 17 at the fastening element 18. Thus, with the bracket 17 rotated clockwise in FIG. 2, the rubbing force by the two blades 12*a* and 12*b* increases. Then, with the two blades 12*a* and 12*b* spaced apart vertically, the rubbing force by the upstream blade 12*a* positioned upper is made greater than that by the downstream blade 12*b* positioned lower.

Disposed under the blade scraper 12 is a guide 19 for accepting a solution scraped off by the blade scraper 12, the solution guide 19 communicating with a drip tray 20 disposed at the lower part of the case 16.

The wiping roll 13 lies downstream of the blade scraper 12 and is rotated reversely in direction with respect to the peripheral surface of the rotating transfer roller 2 while in contact therewith. The wiping roll 13 is formed over its peripheral portion of a sponge and rotated reversely in direction with respect to the peripheral surface of the transfer roller 2 to rub and wipe the surface of the transfer roller 2.

Disposed under the wiping roll 13, the squeezing roll 14 is in pressure contact with the wiping roll 13 upstream of a point of contact of the wiping roll 13 with the transfer roller 2. The squeezing roll 14 is rotated normally in direction with respect to the peripheral surface of the rotating wiping roll 13. Under the squeezing roll 14 there is disposed the drip tray 20 mentioned above.

The brush roll 15 is disposed to contact with the peripheral surface of the wiping roll 13 downstream of an area of rubbing contact of the wiping roll 13 with the transfer roller 2 and upstream of the squeezing roll 14 contacting with the wiping roll 13. And, the brush roll 15 is rotated reversely in direction with respect to the peripheral surface of the wiping roll 13. Under the brush roll 15 there is disposed a trough 21 for accepting the cleaning carrier solution and a lower part of the brush roll 15 is immersed in the carrier solution in the trough 21.

The wiping roll 13, the squeezing roll 14 and the brush roll 15 are interlocked together by a gear mechanism and driven by a single motor (not shown) as their common drive source whose speed of rotation can freely be controlled and that the wiping roll 13 can controllably be rotated to follow rotation of the transfer roller 2 or can freely be set at an optimum speed of rotation for rotation of the transfer roller 2. Note that each of the rolls 13, 14 and 15 may also be driven individually by a single motor. And, driving the wiping roll 13 in rubbing contact with the transfer roller 2 with a single motor allows the number of rotation of the wiping roll 13 to be selected as desired at an optimum number of rotation which is high in cleaning effect and permits an optimum cleaning effect to be achieved over an entire range of all usable image recording speeds following changes in image recording speed.

The carrier solution supply device 11 shown in FIG. 2 comprises a carrier solution supply roll 22, a carrier solution source roll 23 and a case 24 to house them.

The carrier solution supply roll 22 may be a roller whose surface is plated with chromium and driven by a single motor so that it is rotated normally in direction with respect to the peripheral surface of the rotating transfer roller 2 and in contact therewith and that the ratio of its surface velocity to that of the transfer roller 2 can be adjusted as desired. Also, a bracket (not shown) which is disposed to support the case 24 on the machine body of electrophotographic printer is driven by a cylinder unit (not shown) mounted on the main frame so that it can be moved rotationally or slidably towards and away from the transfer roller 2 and that such rotational or sliding movement of the case 24 may adjust the contact pressure between the carrier solution supply roll 22 and the transfer roller 2. It may be noted that an upper limit of the contact pressure is then set by a stopper (not shown).

The carrier solution source roll 23 may be a rubber wound roll which is interlocked and driven via gears with the carrier solution supply roll 22 so as to rotate normally in direction with respect to the peripheral surface of the rotating carrier solution supply roll 22. And, the carrier solution source roll 23 is supported by an eccentric bearing such that turning the eccentric bearing may move its shaft position towards and away from the carrier solution supply roll 22 to adjust the contact pressure of the carrier solution source roll 23 against the carrier solution supply roll 22.

The carrier solution source roll 23 has a lower part thereof immersed in the carrier solution in a carrier solution reserving trough 25 so that as it is rotated while contacting with them, the carrier solution can be supplied onto the carrier solution supply roll 22. And, its rate of supply is adjusted by increasing and decreasing the contact pressure mentioned above.

In the form of implementation described above, the carrier solution used in the transfer roller cleaning device 10 and the carrier solution supply device 11 may be a solvent for the liquid toner used in development in the development unit 6.

In the makeup mentioned above, the surface of the transfer roller 2 after the secondary transfer to the recording medium 7 during a printing operation of the electrophotographic printer has a thin film of the carrier solution applied from the carrier solution supply roll 22 in the carrier solution supply unit 11 and is then cleaned by the transfer roller cleaning device 10.

At that time, the surface of the transfer roller 2 which has secondarily transferred in the transfer area to the recording medium 7 has the carrier solution contained in the toner absorbed into the recording medium 7 becomes dried while the residual toner that remain are also dried. However, the residual toner supplied with the carrier solution from the carrier solution supply roll 22 are softened.

The major portion of the residual toner thus softened are, together with the carrier solution applied for softening, first scraped off by the scraping blades 12*a* and 12*b* of the blade scraper 12. The residual toner and carrier solution scraped off are led through the guide 19 into the drip tray 20.

Subsequently, the surface of the transfer roller 2 is brought into rubbing contact with the reversely rotating wiping roll 13 by which fine residual toner and carrier solution which have not be taken off by the blade scraper 12 are wiped off by the wiping roll 13. And, the wiping roll 13 contaminated by wiping off is cleaned with the rotating brush roll 15 in pressure contact with the wiping roll 13 and a flushing carrier solution supplied through the brush roll 15. And, the flushing carrier solution supplied onto the wiping roll 13 from the brush roll 15 is squeezed off by the squeezing roll 14 before the wiping roll 13 is brought into rubbing contact with the photoconductor drum 1. The carrier solution squeezed off is discharged through the tray 20 into the outside.

While in the form of implementation described above, the blade scraper 12 is shown comprising two scraping blades 12*a* and 12*b*, they may be replaced by one or three or more blades.

As the wiping roller 13 in the transfer roller cleaning device 10 is made of sponge, its large capacity of absorbing the residual toner and the carrier solution is advantageously exploited to cleanly clean the surface of the transfer roller 2. The surface of the sponge roll easily damaged are beneficially cleaned by the brush roller 15 for its use over a prolonged service life.

What is claimed is:

1. An electrophotographic printer in which a toner image formed on a rotating photoconductor drum is transferred via a rotating transfer roller onto a recording medium and in which a surface of the rotating transfer roller, after the transfer, is cleaned by a transfer roller cleaning device, the electrophotographic printer comprising:

a carrier solution supply device disposed in an area upstream of said transfer roller cleaning device in a rotation direction of said rotating transfer roller for supplying a surface of said rotating transfer roller with a carrier solution;

wherein the carrier solution supply device comprises a carrier solution supply roll, a carrier solution source roll and a case for housing the carrier solution supply roll and the carrier solution source roll, said case being movable rotationally or slidably towards and away from the rotating transfer roller to adjust a contact pressure between the carrier solution supply roll and the rotating transfer roller.

2. The electrophotographic printer as set forth in claim 1, wherein said transfer roller cleaning device includes:

disposed in the rotation direction of the rotating transfer roller, a blade scraper in contact with the surface of said rotating transfer roller and a wiping roll rotating reversely in rubbing contact with the surface of said rotating transfer roller, a brush roll disposed to rotate reversely in contact with a surface of the rotating wiping roll, a portion of said brush roll being immersed in the carrier solution, and a squeezing roll disposed to rotate normally in pressure contact with the surface of said rotating wiping roll.

3. An electrophotographic printer in which a toner image formed on a rotating photoconductor drum is transferred via a rotating transfer roller onto a recording medium and in which a surface of the rotating transfer roller, after the transfer, is cleaned by a transfer roller cleaning device, the electrophotographic printer comprising:

a carrier solution supply device disposed in an area upstream of said transfer roller cleaning device in a rotation direction of said rotating transfer roller for supplying a surface of said rotating transfer roller with a carrier solution;

wherein said transfer roller cleaning device includes:

disposed in the rotation direction of the rotating transfer roller, a blade scraper in contact with the surface of said rotating transfer roller and a wiping roll rotating reversely in rubbing contact with the surface of said rotating transfer roller, a brush roll disposed to rotate reversely in contact with a surface of the rotating wiping roll, a portion of said brush roll being immersed in the carrier solution, and a squeezing roll disposed to rotate normally in pressure contact with the surface of said rotating wiping roll.

* * * * *